US009228777B2

(12) United States Patent
Arslankiray et al.

(10) Patent No.: US 9,228,777 B2
(45) Date of Patent: Jan. 5, 2016

(54) COOLING DEVICE COMPRISING A DISPENSER

(71) Applicant: BSH Bosch and Siemens Hausgeräte GmbH, München (DE)

(72) Inventors: Ziya Arslankiray, Tekirdag (TR); Cemalettin Hastürk, Tekirdag (TR); Murat Sögüt, Tekirdag (TR)

(73) Assignee: BSH HAUSGERÄTE GMBH, Munich (DE)

( * ) Notice: Subject to any disclaimer, the term of this patent is extended or adjusted under 35 U.S.C. 154(b) by 0 days.

(21) Appl. No.: 14/319,146

(22) Filed: Jun. 30, 2014

(65) Prior Publication Data

US 2015/0020537 A1 Jan. 22, 2015

(30) Foreign Application Priority Data

Jul. 16, 2013 (TR) ..... 2013/08558

(51) Int. Cl.
*F25D 23/02* (2006.01)
*F25D 23/12* (2006.01)

(52) U.S. Cl.
CPC ..... *F25D 23/126* (2013.01)

(58) Field of Classification Search
CPC ..... F25D 23/02; F25D 23/126; B67D 1/0857; F25C 5/005
USPC ..... 62/389, 391; 222/173, 691
See application file for complete search history.

(56) References Cited

U.S. PATENT DOCUMENTS 6,135,173 A * 10/2000 Lee et al. ..... 141/361

* cited by examiner

*Primary Examiner* — Cassey D Bauer
(74) *Attorney, Agent, or Firm* — Nixon & Vanderhye, P.C.

(57) ABSTRACT

The invention is a cooling device, possibly a refrigerator, comprising a dispenser for distribution of ice and/or water having a housing, which is disposed on an outer wall of the cooling device and has an opening on a front face thereof for a fixing element to fix position of the housing on the outer wall; a front cover disposed on the housing as covering the front face of the housing; and that the front cover comprises an opening corresponding with the opening of the housing and providing access to the fixing element; and a cover for covering the opening of the front cover.

9 Claims, 6 Drawing Sheets

COOLING DEVICE COMPRISING A DISPENSER

This application claims priority to Turkish Application No. TR 2013/08558 filed 16, Jul. 2013, the entire contents of which is hereby incorporated by reference.

TECHNICAL FIELD

The present invention relates to a cooling device having a dispenser which is located on an outer wall and which comprises a housing having an opening on its front face for accommodating a fixing element for securing the location of the dispenser on the outer wall of the cooling device, said dispenser further comprising a front cover located in the housing such that it covers the front face of the housing.

PRIOR ART

Some of the cooling devices, particularly refrigerators, comprise a dispenser for dispensing water or ice for the users. Dispensers are usually located on the front face of the doors of the cooling devices. For this purpose, a cavity or a cove is formed on the door. Then, a housing which is usually made of a plastic and which geometrically fits with the inner volume of said cavity is placed in said cavity. The housing is fixed to the door using a desired fixing element, such as a screw. In case of a built-in type cooling device, the location of the dispenser is adapted against a corresponding opening found on the cover plate (decorative panel) during installation.

One or more openings are provided on the housing for handling the installation. The fixing element may be controlled and secured through said openings. However, visibility of the fixing element or reach of the same to a user is unwanted. Therefore, the fixing element shall be concealed.

For concealment, a front cover which geometrically fits with the cavity is used. The front cover conceals the cavity by covering the same partly or fully. In such cases, and particularly in the case of built-in type systems, adaptation of the location of the dispenser requires a multiplicity of adjustments through the fixing elements and control checks after the front cover is put in place. This usually requires a long installation time and high amount of labor.

The present invention brings a development, an extra advantage or an alternative to the state of the art.

OBJECTS OF THE INVENTION

Primary object of the invention is to provide a cooling device having dispenser whose installation is made easier albeit the front cover.

In order to achieve the object, the present invention proposes a cooling device comprising a dispenser for distribution of ice and/or water, said dispenser having a housing, which is disposed on an outer wall of the cooling device and which has an opening on a front face thereof for a fixing element for fixing the position of the housing on the outer wall of the device; a front cover disposed on the housing as covering the front face of the housing; wherein the front cover has an opening corresponding the opening of the housing and allowing access to the fixing element and wherein said front cover has a cover for covering the opening of the front cover. Thereby, access to the fixing element for adjustment and/or securing of the housing can be established even when the front cover is mounted on the housing.

The cooling device may be any of the cooling devices on which a dispenser may be installed. For example, it may be a household refrigerator. The refrigerator may be a stand-alone type or a built-in type already known in the state of the art.

The dispenser disclosed by the present invention may be a food dispenser. For example, it may be used for dispensing a liquid like water and/or ice. The outer wall used for installing the dispenser may be an outer wall to which a user has reach. For example, in a possible cooling device having a door, the dispenser may be located on the outer wall of the door.

The fixing element securing the location of the housing on the cooling device may be any of the mechanical, magnetic, electronic etc. fixing elements known in the state of the art. For example, it may be a screw, a bolt-nut couple, a snap-on type connecting tab etc.

The housing may be a housing having a dispenser valve as known in the art. It may be formed such that it has a cavity suitable to get a food container in. It may be located in a cavity or a cove to be formed on the outer wall of the cooling device. The housing may be made of a material such as plastics, composite materials known in the state of the art. It may comprise one or more openings. An opening may allow access to one or more fixing elements.

The front face of the housing may be any of its faces facing a user. For example, it may be front face of the wall or walls defining the cavity in which the food container is located.

The front cover may be embodied such that it covers the entire front face of the housing. It may comprise a frame covering the periphery of the cavity of the housing and a cavity region extending in between the periphery of the inner space of the frame and the cavity of the housing. The cavity region may establish that the walls defining the cavity of the housing are covered. The front cover may be mechanically connected to the housing such that it covers the front face of the housing. In another embodiment, the front cover may be adhered to front face of the housing. The front cover may be generally made of a sheet material.

The dimensions of the opening of the front cover may be equal to the dimensions of the opening of the housing or may be slightly less than the same such that a fixing element may still be accessible or alternatively, the dimensions of the opening of the front cover may be larger than that of the opening of the housing.

The cover may be dimensioned such that it covers the opening of the front cover partly or fully.

In a possible embodiment of the invention, the cover may have a connection element which is connected to the front cover. In this way, the cover may sit on the front cover in a stable manner. In the possible embodiment, the connection element may be formed as secured to the rear wall of the cover. In this way, a secure connection may be established in between the cover and the front cover. Furthermore, labor work for establishing a connection in between the connection element and the cover can be prevented. The connection element may be secured to the cover through known techniques such as adhesion or welding. However, in another possible embodiment of the invention, the connection element can be secured to the cover in an adjustable manner. The connection element may be connected to the cover before the cover is attached to the front cover. The connection element may be made of a material which is same or different than the material of the cover. For example, it may be a metal or plastics. If made of plastics, the manufacture of the desired form may be facilitated.

In a possible embodiment of the invention, the front cover may have a connection element which is in connection with the connection element of the cover. In this way, a secure connection can be established in between the cover and the front cover. The connection element may be secured to the cover through known techniques such as adhesion or welding. The connection element may be made of a material which is same or different than the material of the front cover. For example, it may be a metal or plastics. If made of plastics, the manufacture of the desired form may be facilitated. The connection element may be in the form of a plate. In this way, it would occupy a small space in between the front cover and the housing such that it would help in obtaining a dispenser which occupies less space.

In a possible embodiment of the invention, one of the connection element of the cover and the connection element of the front cover comprises a holding element in connection with a holding edge of other one of the connection element of the cover and the connection element of the front cover corresponding with the holding element. In this way, a mechanical connection can be established in between the cover and the front cover. This mechanical connection provides that the installation work can be handled easily and fast. This would be beneficial in terms of labor amount and time. The holding element may be a known element such as a lug or a clamp. The holding edge may be any of the edges provided on the fixing element of the front cover. As an example, for a clamp type holding element it may be any unused edge or the inner edges of an opening formed on a plate.

In a possible embodiment of the invention, when the cover is placed on the opening of the front cover, the opening of the front cover can be formed such that a front face of the cover and a front face of the front cover align. In this way, the connection in between the cover and the front cover may geometrically be fitting each other. Furthermore, as the front faces align with each other, the edges or the corners of the cover may be prevented from constituting a protrusion which may harm a user or a tool (such as a cleaning tool or cleaning object). Additionally, the harmonious appearance of the cover and the front cover may enhance user satisfaction.

In a possible embodiment of the invention, the front cover and the cover may be made of the same material, such as a metal. In this way, the strength of connection in between the front cover and the cover may be enhanced. The front cover and the cover may also be made of a different material which is known to have a high physical strength.

DETAILED DESCRIPTION OF THE INVENTION

Figure 2:
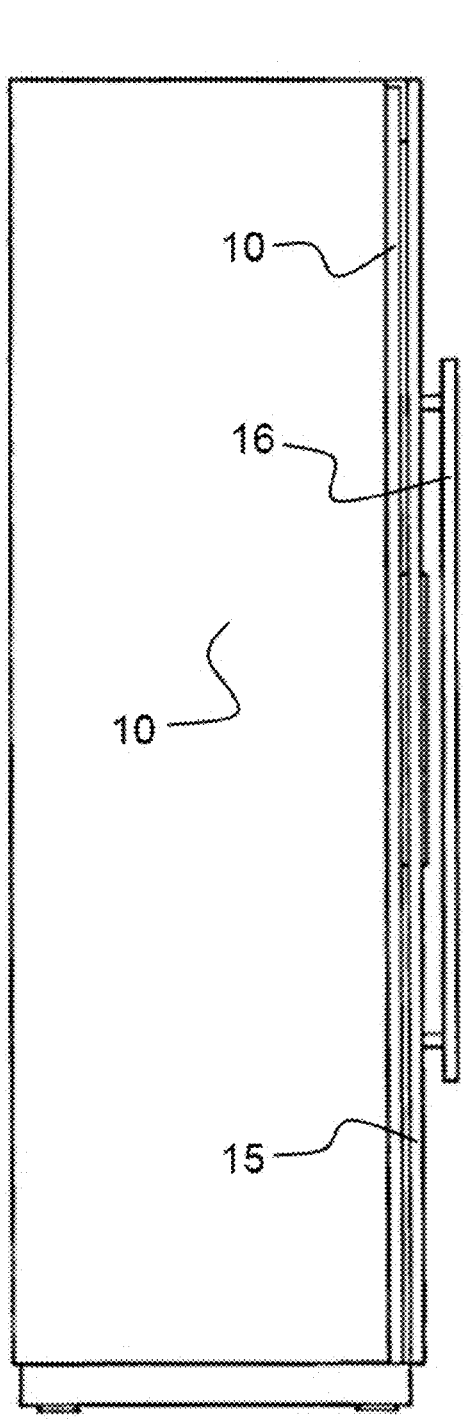
FIG. 2 presents side view of the built-in type cooling device shown in FIG. 1.

All directional references such as front, top or bottom views used in this text are based on reference to the cooling device (1) shown in to FIG. 2 in which the visible side is the "left" side and the right part of the device (1) is the "front" of said cooling device. One or more of possible embodiments of the present invention will be described as examples in detail below.

Figure 1:
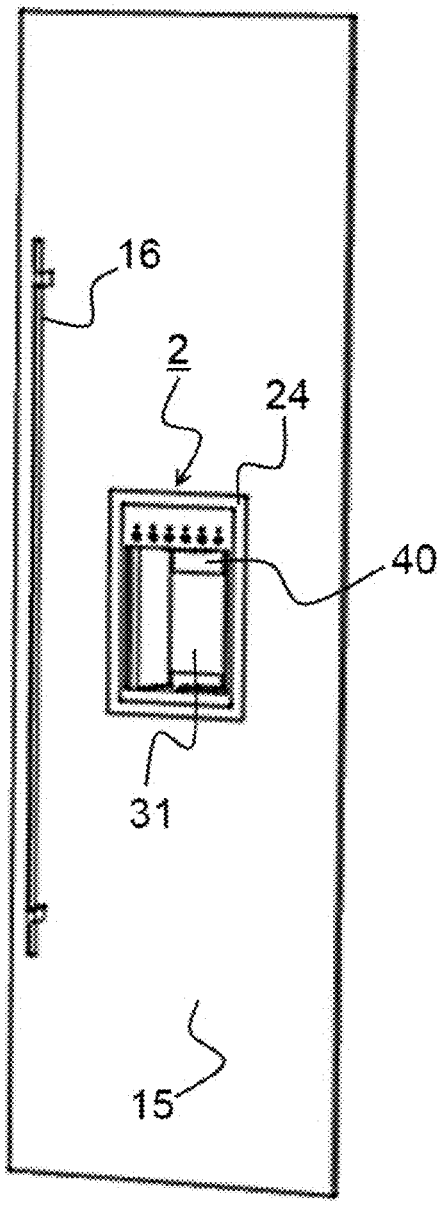
FIG. 1 presents a schematic frontal view of the cover plate of a built-in type cooling device having a possible dispenser.

The present invention relates to a cooling device (1), such as a refrigerator, comprising a dispenser (2) for distribution of ice and/or water, said dispenser having a housing (20), which is disposed on an outer wall (10) of the cooling device (1) and which has an opening (22) on a front face (21) thereof for a fixing element (23) for fixing the position of the housing (20) on the outer wall (10) of the device. Left side view of a possible built-in type refrigerator is displayed in FIG. 2. The cover plate (15) and the dispenser (2) shown in FIG. 2 are presented in FIG. 1. The cover plate (15) is displayed with a door handle (16) for opening of the door to which a cover plate (15) is attached. The dispenser (2) is located within the opening of the cover plate (15). Control buttons (25) and the cavity (26) for accommodating a fluid container in the dispenser (2) have been shown.

Figure 3:
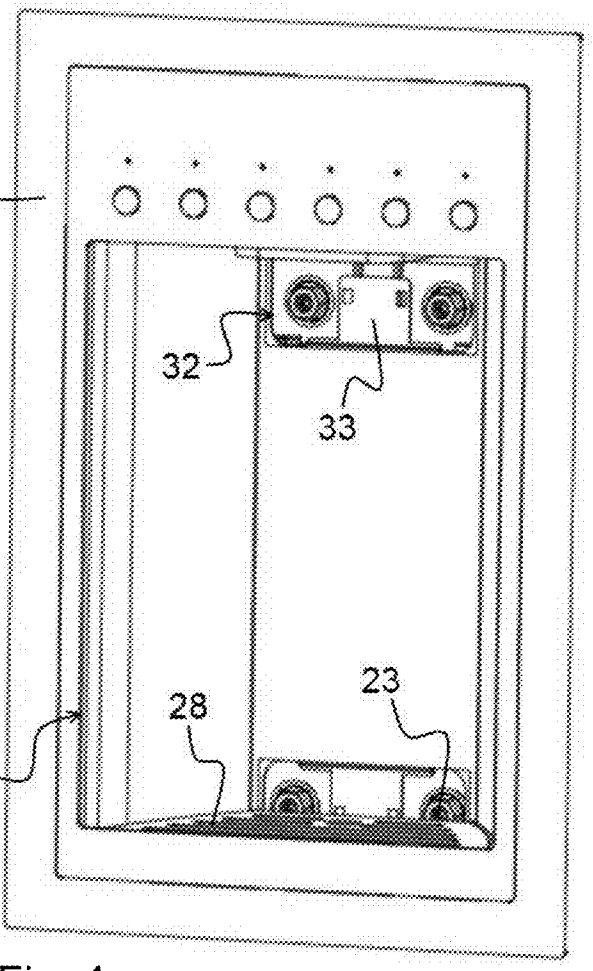
FIG. 3 presents a close up view of the dispenser shown in FIG. 1.

A close up view of the dispenser (2) is illustrated in FIG. 3. The housing (20) covered with the front cover (30) and the front cover (30) itself provide a cavity (26). Control buttons (25) are located on the upper part of the cavity (26) in a state flush with the outer wall (10) of the cooling device (1). Two covers (40) are located on the inner wall of the cavity (26), i.e. on the front cover (30) which covers the front face (21) of the housing (20). While one of the covers (40) is in the proximity of the upper edge of the cavity (26) the other is in the proximity of the lower edge of the cavity (26). A tray (27) is located in front of the lower cover (40). The tray (27) provides a sump for accumulation of water flowing through the dispenser and spilling out of a liquid container. A grate (28) is located on top of the tray (27). The grate (28) may support a liquid container where a user does not hold the liquid container. Additionally, it allows liquids to be conveyed to the tray (27) pass through. In case of a built-in type cooling device (1), a frame (24) is placed around the front face of the dispenser (2). It conceals possible gaps between the openings of the cover plate (15) and the dispenser (2).

Figure 4:
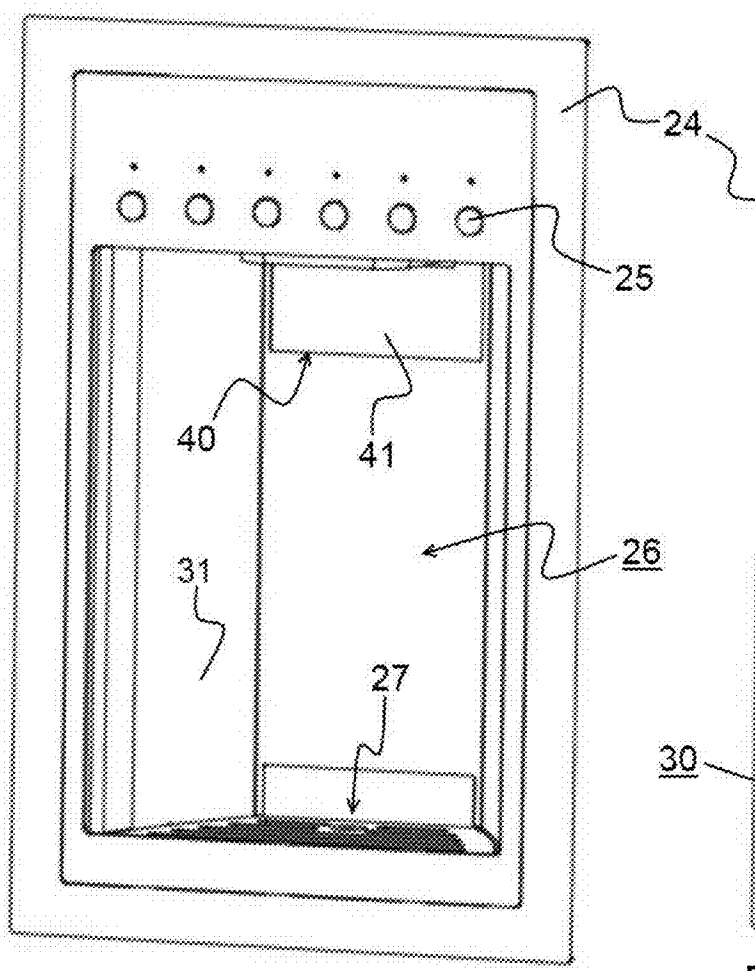
FIG. 4 presents the view of the dispenser shown in FIG. 3 in a state where the covers are removed from the front cover.

FIG. 4 presents the dispenser (2) shown in FIG. 3 in a state where the covers (40) have been removed. The opening (22) of the housing (20) and the fixing elements (23) are accessible underside the covers (40). In a possible embodiment, two fixing elements (23) are located under each of the covers (40). When the cover (40) is removed, the connection element (33) of the front cover (30) becomes visible.

Figure 5:
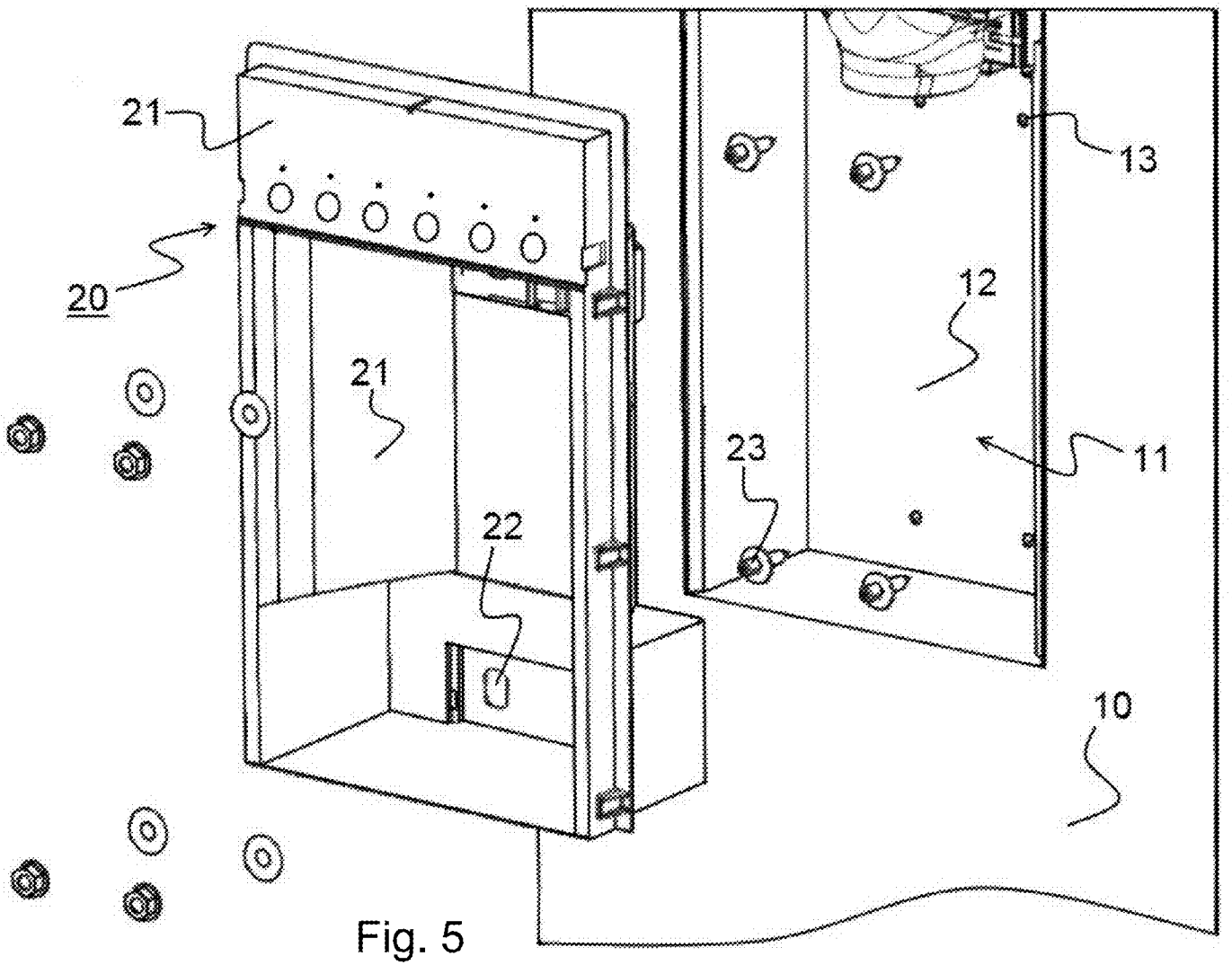
FIG. 5 presents an exploded view of dispenser housing, fixing elements and the wall of the cavity formed on the cooling device for accommodating the housing of the dispenser.

FIG. 5 shows, partially, a cooling device (1) in which a cavity (11) is provided on the outer wall (10) of the device. In this state, the cover plate (15) is yet not applied. The housing (20) of the dispenser (2) is shown at a certain distance in front of the cavity (11). The figure also exemplifies the housing (20) with four pieces of fixing elements (23), washers and nuts which connects the housing to the cavity (11).

The cavity (11) of the cooling device (1) is roughly in the form of a rectangular prism. It is connected to the dispenser reservoir located inside the cooling device (1) through a valve which is provided on its upper part and which allows obtaining of liquids or solids. Four pieces of fixing slots (13) are provided on the rear wall (12) of the cavity (11). A fixing slot element is provided in each of the fixing slots (13). A fixing slot element is a metal element which is molded with the cavity (11) that is made of plastics when so desired. It has a dowel-like structure.

The housing (20) of the dispenser (2) has a form which fits inside the cavity (11). On its front face (21), it has openings (22) which correspond to the fixing slots (13) of the cavity (11). An opening (22) has a form roughly corresponding to a quadrilateral. The inner uppermost portion of the housing (20) is left hollow for allowing the valve extend inside the housing (20).

The fixing elements (23) as proposed by the present invention are screws. Screws have a head which allows them to be rotated by a screwdriver around their primary axis. Additionally, they have an integral washer in the proximity of the head. As the integral washer is wider than the opening (22) of the housing (20), only the head of the fixing element (23) remains inside the housing (20).

The housing (20) of the dispenser (2) is located on the screws which were driven in the fixing slots (13) of the cavity (11). Later on an external washer is placed on each of the heads remaining in the housing (20). The external washer is wider than the opening (22). Finally, a nut-like element is added to each of the heads which have a thread/ridge on their outer lateral surfaces.

Figure 6:
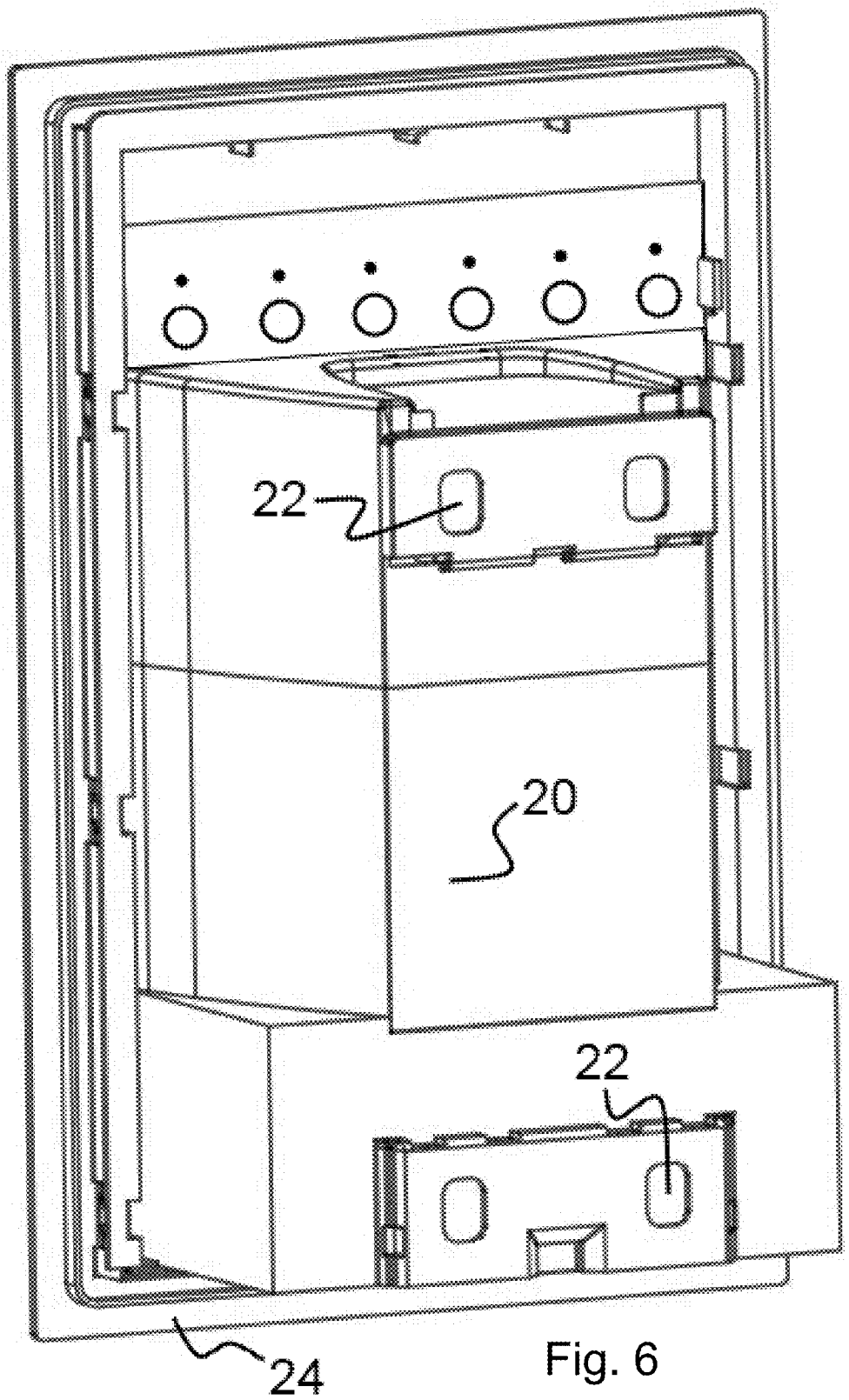
FIG. 6 presents the rear view of the dispenser shown in FIG. 1.

FIG. 6 presents the rear view of the housing (20). The housing (20) is made of a plastic material. When the housing (20) is viewed from its rear, the walls defining the cavity (26) formed on the housing (20) can be clearly seen. The opening left for the valve inside the top wall of the housing (20) can be seen in this same figure. The frame (24) is depicted in its position.

Figure 8:
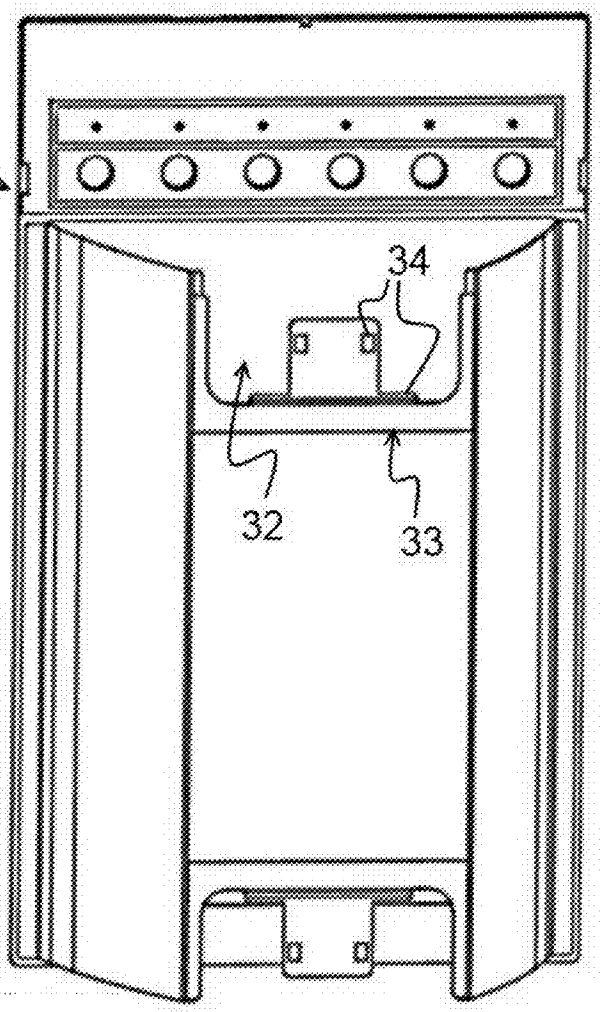
FIG. 8 presents solely the rear view of the front cover shown in FIG. 7.
Figure 7:
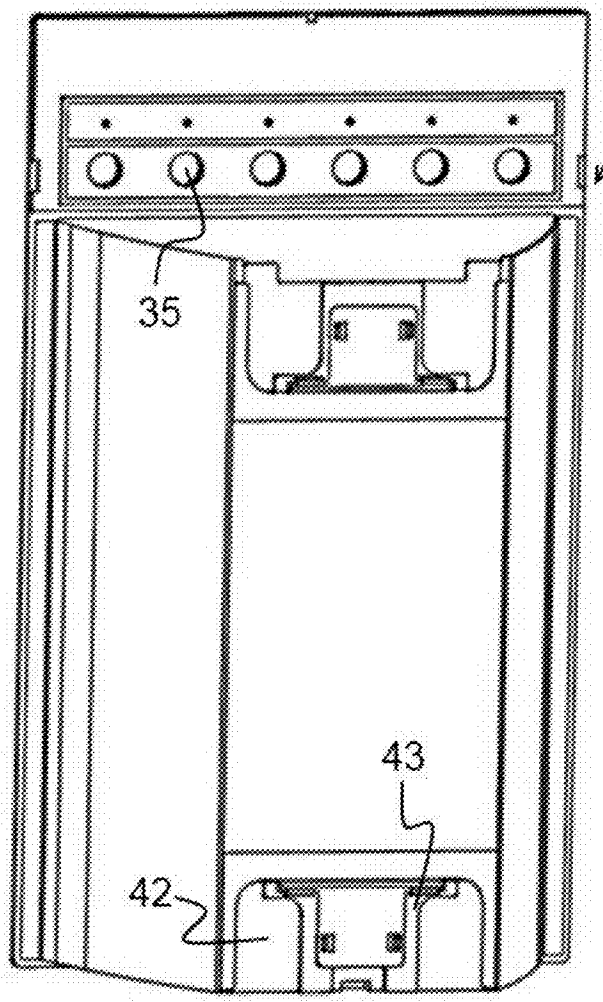
FIG. 7 presents the view of FIG. 6 in a state where the dispenser housing is removed, i.e. the front cover and the covers are illustrated.

FIG. 7 presents the rear view of the front cover (30). Accordingly, the front cover (30) comprises walls and faces corresponding to the entire front face (21) of the housing (20). The front cover (30) is made of a metal, particularly a stainless metal (stainless steel etc.). The upper part of the front cover (30) is in the form of a flat plate, as was in the case of the housing (20). This part is approximately at the same level with the outer wall (10) of the cooling device (1). In case the cooling device is a built-in type, the upper part under discussion is approximately at the same level with the cover plate (15). Button slots (35) for control buttons (25) are located on the upper portion. Walls forming the cavity (26) on the front cover (30) have openings (32) for fixing elements (23). These openings (32) are concealed with covers (40). The connection element (33) of the front cover (30) is also depicted in the figure. The connection element (33) is in the form of a plate. It has edges that partly surround the periphery of the opening (32). In the figure, it is illustrated as surrounding three edges of the opening (32). A separate plate is located extending from one of these edges towards the mid portion of the opening (32). This plate is provided a holding edge (34) for a holding element (44) which is located on the cover (40) and which will be described further below and the cover is thereby maintained in its position. The holding edge (34) is the inner edge of an opening which is formed on the plate as clearly seen in FIG. 8. Additionally, the holding edges (34) may also be formed on the onset of the plate extending towards the mid portion of the opening (32). The connection element (33) may be integral to the front cover (30). However, in various embodiments the connection element (33) and the front cover (30) are connected to each other through adhesion or welding. The end of the connection element (33) which extends towards the opening (32) is first bent, to a certain extent, towards the housing (20) and then extends towards the mid portion of the opening (32). In this way, a certain gap remains in between the opening (32) and the aforementioned part of the connection element (33). This gap ensures that when the cover (40) is located in the opening (32), the front face (41) of the cover (40) becomes flush with the front face (31) of the front cover (30).

Figure 9:
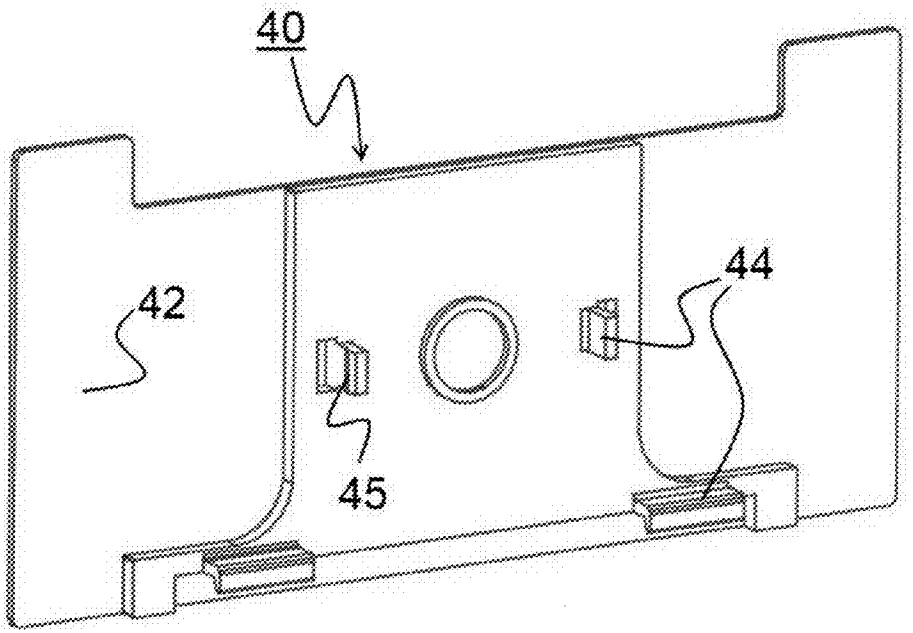
FIG. 9 presents the rear view of the cover which covers the upper opening of the front cover shown in FIG. 8.
Figure 10:
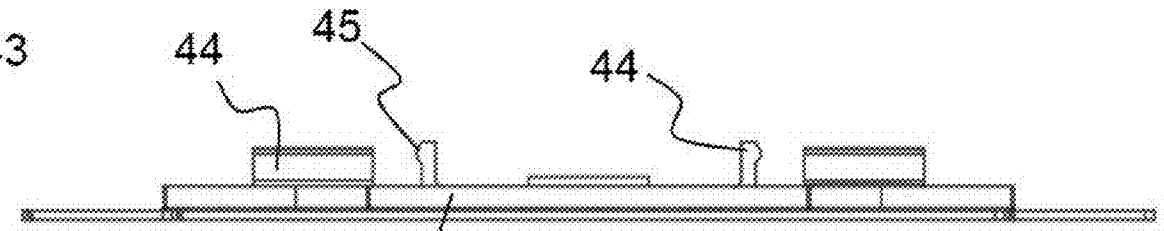
FIG. 10 presents the lower view of the cover shown in FIG. 9.
Figure 11:
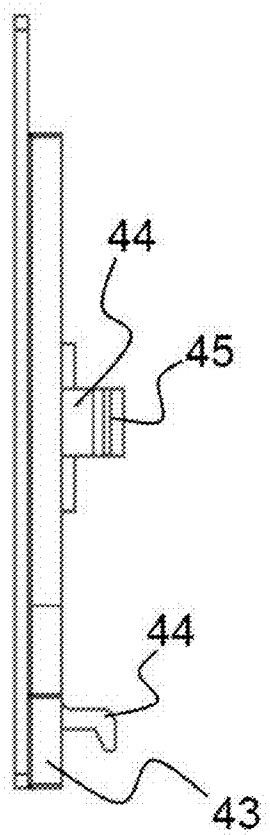
FIG. 11 presents the left side view of the cover shown in FIG. 9.

FIG. 9 presents the rear view of the cover (40). FIG. 10 and FIG. 11 presents, respectively, bottom and side (right) view of the same. The cover (40) comprises a plate and a connection element (43) which is in the form of a plate having connection lugs and which is fixed to the rear face of said plate. The plate forming the front face (41) of the cover (40) is made of a metal, particularly a stainless metal (stainless steel etc.) similar to the material of the front cover (30). The connection element (43), however, is made of plastics. It is subsequently fixed to the metal plate through adhesion. Similar to the connection element (33) of the front cover (30), the connection element (43) has a portion which corresponds to the opening (32) and another portion which corresponds to the edge of the connection element (33) of the front cover (30). Both portions have holding elements (44). The holding elements (44) are connection lugs as known in the prior art. Connection elements (43) have two opposed lugs in the proximity of the mid portion of the opening (32). The protrusions of the lugs face opposing directions. The lugs in the proximity of the edge have an "L" shaped cross section. In this way, they can be connected to an edge of the connection element (33) of the front cover (30).

For installation of a cooling device (1) as described in detail above, the following method shall be applied. The method comprises the following steps;

a. a front cover (30) is fixed on the housing (20) of a dispenser (2),
b. the housing (20) is placed in a cavity (11) provided in an outer wall (10) of the cooling device (1),
c. a fixing element (23), which penetrates through respective openings (22, 32) of the housing (20) and the front cover (30) and which connects with a fixing slot (13) element of the cavity (11) is loosened,
d. the position of the housing (20) of the dispenser (2) is adjusted through the opening (32) of the front cover (30) and the opening (22) of the housing (20),
e. the fixing element (23) is tightened and the position of the housing (20) is secured, and
f. the cover (40) of the front cover (30) is located on the opening (32) of the front cover (30)

In a possible embodiment where the cooling device is a built-in type device, the method step of locating a cover plate (15) on the outer wall (10) of the cooling device (1) may be added right after step b described above.

In a possible embodiment where the cooling device is a built-in type device, the method step d may also be conducted through the opening of the cover plate (15).

In a possible embodiment where the cooling device is a built-in type device, following the method step f, a frame (24) may be added in between the cover plate (15) and the dispenser (2) in order to conceal the gap in between the cover plate (15) and the dispenser (2).

The front cover (30) may be secured to the housing (20) through adhesion or a snap-on fixation.

| Reference Numerals |
|---|
| 1. Cooling device |
| 10. Outer wall |
| 11. Cavity |
| 12. Rear wall |

-continued

| Reference Numerals |
|---|
| 13. Fixing slot |
| 15. Cover plate |
| 16. Handle |
| 2. Dispenser |
| 20. Housing |
| 21. Front face |
| 22. Opening |
| 23. Fixing element |
| 24. Frame |
| 25. Control button |
| 26. Cavity |
| 27. Tray |
| 28. Grate |
| 30. Front cover |
| 31. Front face |
| 32. Opening |
| 33. Connection element |
| 34. Holding edge |
| 35. Button slot |
| 40. Cover |
| 41. Front face |
| 42. Rear wall |
| 43. Connection element |
| 44. Holding element |
| 45. Protrusion |

The invention claimed is:

1. A cooling device comprising a dispenser for distribution of ice and/or water comprising:

a removable housing configured to be installed within a cavity within an outer wall of the cooling device;

a first opening on a front face of the housing, the first opening being configured to receive a fixing element, the fixing element being configured to fix the housing in a position on the outer wall within the cavity;

a front cover configured to substantially cover at least a plurality of vertical surfaces of the front face of the housing;

a second opening on the front cover, the second opening correspond with the first opening and further being configured to provide access to the fixing element within the first opening; and a cover configured and arranged to cover the second opening.

2. A cooling device according to claim 1; wherein the cover comprises a connection element in connection with the front cover.

3. A cooling device according to claim 2; wherein the connection element is configured as fixed to a rear wall of the cover.

4. A cooling device according to claim 2; wherein the front cover comprises a connection element in connection with the connection element of the cover.

5. A cooling device according to claim 2; wherein one of the connection element of the cover and the connection element of the front cover comprises a holding element in connection with a holding edge of other one of the connection element of the cover and the connection element of the front cover corresponding with the holding element.

6. A cooling device according to claim 1; wherein the first opening of the front cover is configured such that a front face of the cover and a front face of the front cover is aligned when the cover is disposed in the second opening.

7. A cooling device according to claim 1; wherein the front cover and the cover are made of a same material.

8. A cooling device according to claim 1, wherein the cover is configured and arranged to fit within the second opening.

9. A cooling device according to claim 1, wherein the cover is configured and arranged to have a shape corresponding to the second opening such that upon installation, the cover and the front cover of the housing form a substantially continuous surface.

* * * * *